United States Patent [19]

Takami

[11] Patent Number: 4,872,818

[45] Date of Patent: Oct. 10, 1989

[54] ROTARY PUMP HAVING ALTERNATING PISTONS CONTROLLED BY NON-CIRCULAR GEARS

[75] Inventor: Akira Takami, Hyogo, Japan

[73] Assignee: Mitsubishi Denki Kabushiki Kaisha, Tokyo, Japan

[21] Appl. No.: 184,553

[22] PCT Filed: Jul. 23, 1987

[86] PCT No.: PCT/JP87/00537

§ 371 Date: Mar. 21, 1988

§ 102(e) Date: Mar. 21, 1988

[30] Foreign Application Priority Data

Jul. 26, 1986 [JP] Japan ..... 61-176288

[51] Int. Cl.[4] ..... F04C 2/077

[52] U.S. Cl. ..... 418/36

[58] Field of Search ..... 418/36; 123/245

[56] References Cited

U.S. PATENT DOCUMENTS

| | | | |
|---|---|---|---|
| 1,329,625 | 2/1920 | Noble | 418/36 |
| 1,701,534 | 2/1929 | Knopp | 418/36 |

FOREIGN PATENT DOCUMENTS

| | | |
|---|---|---|
| 50-20116 | 3/1975 | Japan . |
| 51-42108 | 4/1976 | Japan . |
| 52-246 | 1/1977 | Japan . |
| 58-79623 | 5/1983 | Japan . |

*Primary Examiner*—John J. Vrablik

*Attorney, Agent, or Firm*—Sughrue, Mion, Zinn, Macpeak and Seas

[57] ABSTRACT

A rotary pump device comprises planet gear devices 4, 5 each composed of a center gear 6, 7, planet gears 8, 9 and an inner toothed annular gear 10, 11, all being non-circular gears, and a mechanism for rotationally moving a plurality of rotary pistons 18, 19 in an annular cylinder 17 at periodically variable speed in synchronism with variable speed orbital movements given to planet shafts 20, 21 by said planet gear devices.

1 Claim, 8 Drawing Sheets

ROTARY PUMP HAVING ALTERNATING PISTONS CONTROLLED BY NON-CIRCULAR GEARS

FIELD OF TECHNOLOGY

This invention relates to a rotary pump device applicable to various gas compressors, various liquid pumps and internal or external combustion engines.

BACKGROUND OF TECHNOLOGY

Figure 1:
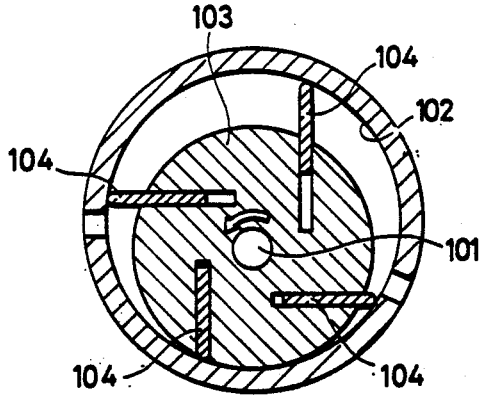
FIG. 1 PRIOR ART
Figure 2:
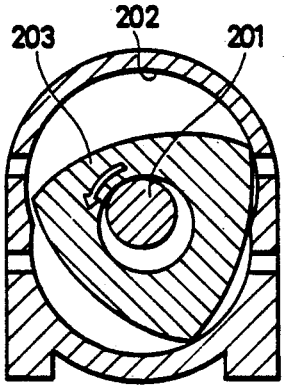
FIG. 2 PRIOR ART
Figure 3:
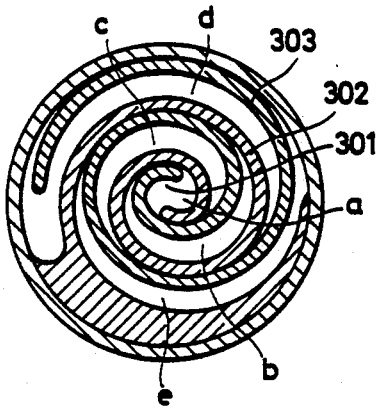
FIG. 3 PRIOR ART

FIGS. 1 to 3 show typical examples of a conventional rotary pump and operations thereof, schematically. In FIG. 1, a vane type rotary pump is shown, in which an inner wall 102 of a housing is eccentric with respect to a center 101 of a rotary shaft so that an area in a plane orthogonal to the rotary shaft defined by an outer wall 103 of a rotor, the inner wall 102 and adjacent vanes 104 increases and decreases periodically with rotation of the pump device. FIG. 2 shows a non-circular rotor type rotary pump in which a rotor and a housing move relatively while they are proximate to each other or in contact with each other at at least two points on a locus curve which is deviated from a coaxial circle with a center 201 of a rotary shaft according to a fixed rule so that an area in a plane orthogonal to the rotary shaft and defined by an outer wall 203 of the rotor and an inner wall 202 of the housing increases and decreases periodically with rotation of the device. A rotary pump shown in FIG. 3 is of a scroll type which includes a stationary scroll 302 and an orbiting scroll 303 which orbits along a predetermined orbit with respect to a center 301 of a rotary shaft so that areas a to e defined between the scrolls in a plane orthogonal to the rotary shaft are increased and decreased periodically while moving spirally. In these typical examples of conventional rotary pumps, the component which performs a pump action has a configuration eccentric with respect to a rotary shaft, rotates eccentrically, has a non-circular configuration other than a coaxial circular with the rotary shaft or moves in special mode such as spiral movement, or employs a combination of two or more of those mentioned above.

Therefore, there are technical problems such as, in these conventional rotary pumps performing eccentric movement, difficulties of minimization of friction between a component which moves eccentrically and a component which does not move eccentrically and maximization of friction durabilities thereof and, in those having a non-circular component, difficulties in machining and in increasing a configuration precision. Since these problems lead to a friction problem and a sealing problem for fluid which affect a performance of the rotary pump directly, a high degree of control technique is necessary in producing such device practically, resulting in a high manufacturing cost.

This invention was made in view of resolution of these problems and an object of this invention is to obtain a rotary pump by which a friction loss can be minimized, machinings of a piston and a cylinder are easy, a loss of driving mechanism can be reduced and a loss of inertia can be restricted.

SUMMARY OF THE INVENTION

A rotary pump device according to this invention comprises a planet gear device composed of a center gear, planet gears and an internally toothed annular gear all of which are non circular gears and a mechanism for rotating a plurality of rotary pistons in an annular cylinder in synchronism with an orbital movement of planet gear shafts at variable speed which is given by the planet gear device.

Figure 6:
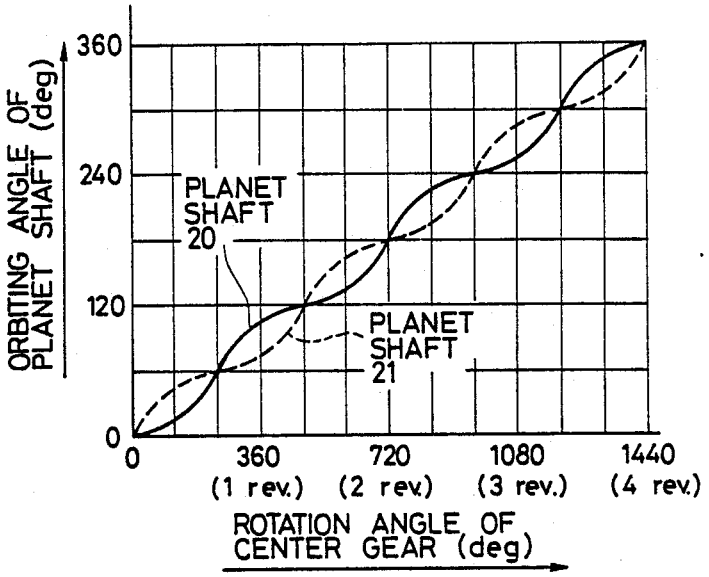
Figure 9:
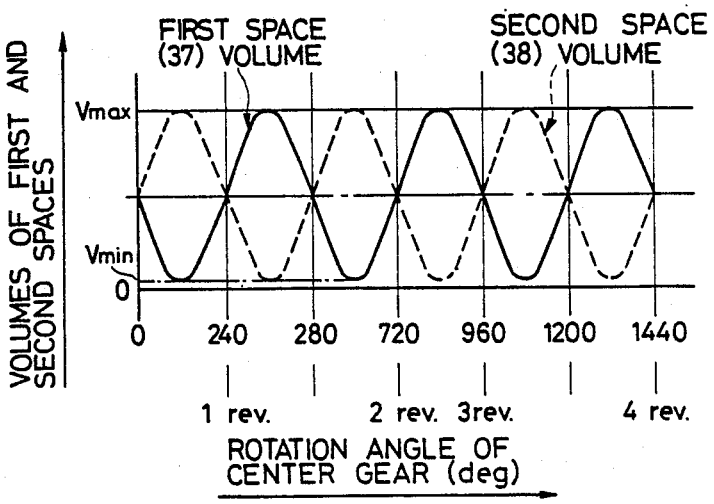
Figure 7A:
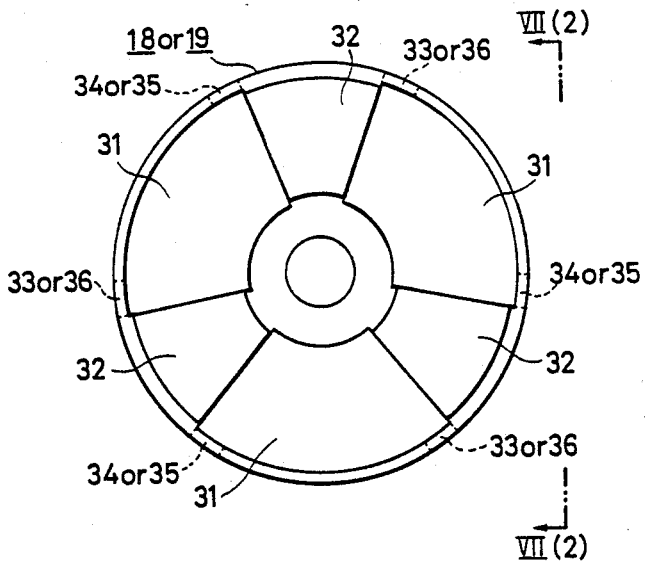
Figure 7B:
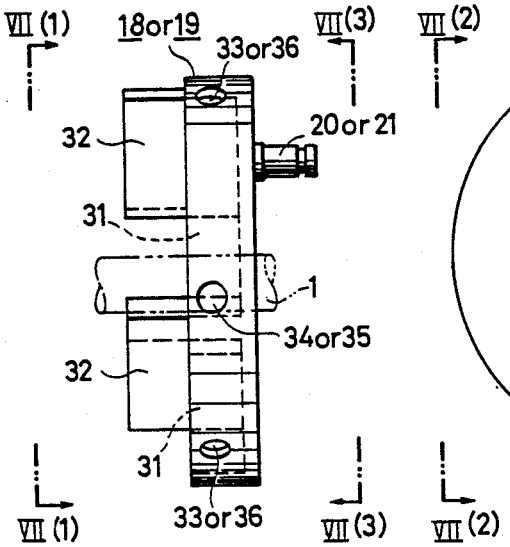
Figure 7C:
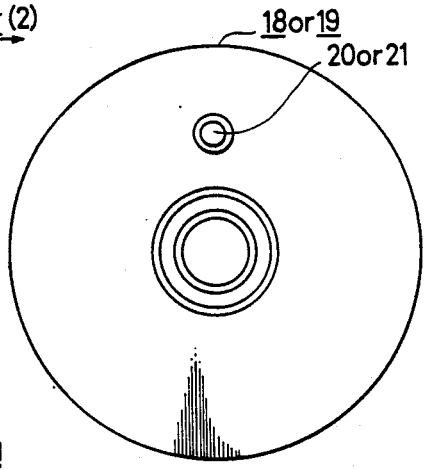

In the rotary pump according to this invention, the plurality of rotary pistons move in the annular cylinder forming an annular space around a center of the rotary shaft, while the pistons are performing discrete movements at variable speed. Therefore, a relative distance between adjacent pistons in the annular cylinder varies and a spacial volume defined by these adjacent pistons and walls of the annular cylinder is increased and decreased periodically with rotation of the device. The periodically variable speed movements of the rotary pistons are given by the periodically variable speed movements of the planet gear shafts produced by the planet gear device including the non-circular gears. Thus, the present device performs a suction and discharge function for fluid such as gas or liquid which can flow through the above mentioned space, a compression function, according to demand, of compressing intake gas and discharging it, or reducing pressure by expanding intake gas and discharging it, as a vacuum pump of some kind. BRIEF DESCRIPTION OF THE DRAWINGS FIGS. 1 to 3 show operations of various conventional rotary pump devices schematically, respectively , FIG. 4 is a front view in cross section of an embodiment of a rotary pump device according to the present invention, FIGS. 5*a* to 5*e* are cross sections taken along a line V—V in FIG. 4 showing various states of the device, FIG. 6 is a graph showing rotational characteristics curves of a planet gear shaft of the device shown in FIG. 4, FIGS. 7*a* to 7*c* show rotary piston units of the device shown in FIG. 4, in which FIG. 7*a* is a front view looked from a line VII(1)—VII(1) in FIG. 7*b*, FIG. 7*b* is a side view looked from a line VII(2)—VII(2) in FIG. 7*a* and from a line VII(2)—VII(2) in FIG. 7*c*, FIG. 7*c* is a rear view looked from a line VII(3)—VII(3), in FIG. 7*b*, FIGS. 8*a* to 8*e* are cross sections taken along a VIII—VIII line in FIG. 4, FIG. 9 is curves showing variations of volumes of a first space and a second space shown in FIGS. 8*a* to 8*e*, FIGS. 10*a* to 10*e* are views looked from a line X—X in FIG. 4, showing an outer periphery of a cylinder base extended in plane, FIG. 11 is a side view showing a detail of an annular manifold of the device shown in FIG. 4.

PREFERRED EMBODIMENTS FOR PRACTICING THE INVENTION

The rotary pump device according to the present invention will be described with reference to the drawings.

Figure 4:
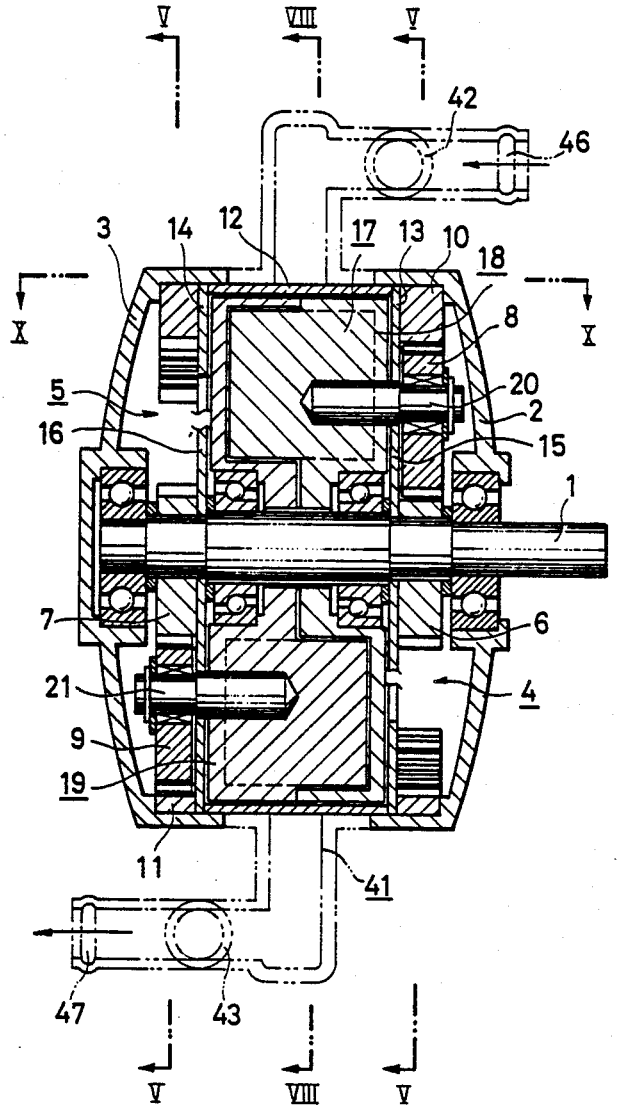

FIG. 4 shows an embodiment of a rotary pump device according to the present invention schematically. In this figure, 1 is a drive shaft, 2 is a front housing, 3 is a rear housing, 4 and 5 are planet gear devices, 6 and 7 are center gears fixed on the drive shaft 1, 8 and 9 are planet gears, 10 and 11 are inner toothed annular gears fixed to the front and the rear housings 2 and 3, respectively. 12 is a cylinder base, 13 and 14 are stationary side walls and 15 and 16 are rotary side walls. The cylinder base 12, the stationary side walls 13 and 14 and the rotary side walls 15 and 16 define an annular space surrounding the drive shaft 1 as a center. This is the annular cylinder or chamber shown by 17. 18 and 19 are rotary pistons which are supported by the drive shaft 1 rotatably with respect to each other within the annular cylinder 17. 20 and 21 are planet gear shafts, the rotary pistons 18 and 19 being rotated by orbital rotations of the planet gears 8 and 9 on the shafts 20 and 21. Although not shown in FIG. 4, the device is assembled by tightening the front and the rear housings 2 and 3 etc. by means of through-bolts etc. Other assembling means for such constitutional components as portions pressure-inserted, bearings, spacers and/or washers are well known and therefore details thereof are omitted. Further, although a suction and discharge portion of the pump device is merely shown by a portion of an annular manifold 41 shown by imaginary line in FIG. 4, details thereof will be described later.

Figure 5A:
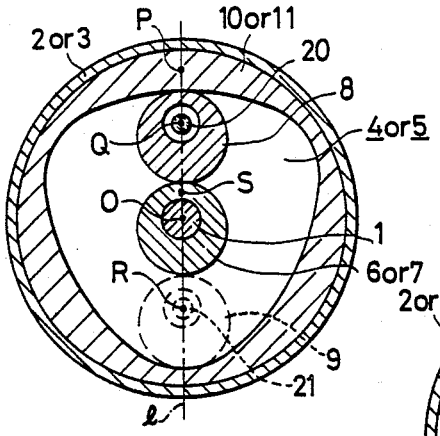
Figure 5B:
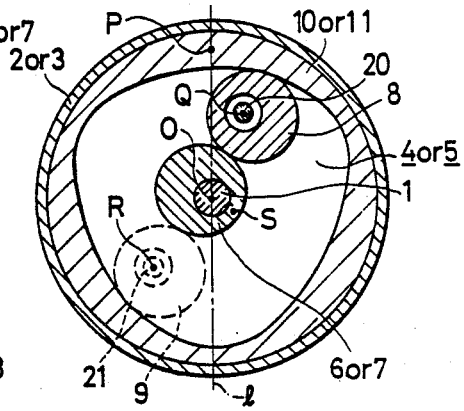
Figure 5C:
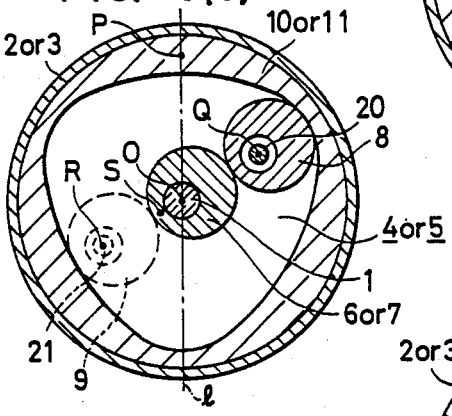
Figure 5D:
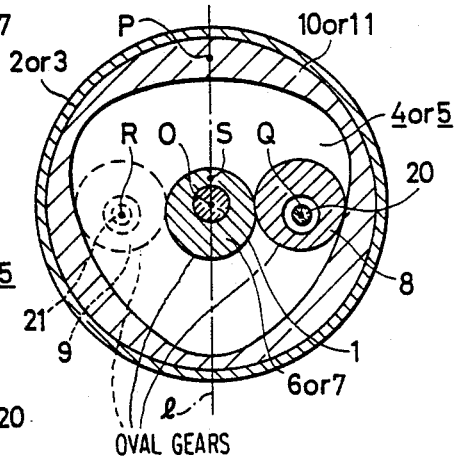
Figure 5E:
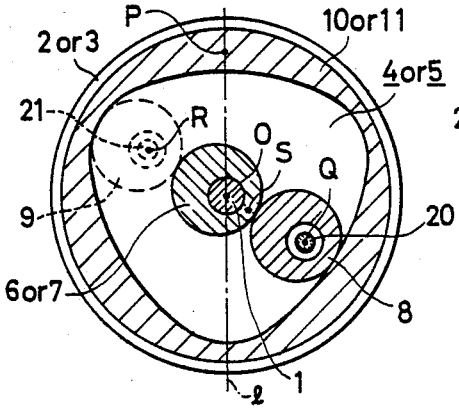

FIGS. 5*a* to 5*e* are vertical cross sections of the rotary shaft 1 of the planet gear device 4 or 5 of the device shown in FIG. 4, teeth thereof being removed for clarification. Configurations of the gears will be described in the order mentioned with respect to FIG. 4. As shown, the center gear 6 or 7 and the planet gear 8 or 9 are non-circular gears, i.e., oval gears and the inner toothed annular gear 10 or 11 has a non-circular inner configuration. The numbers of teeth of the center gear 6 or 7 and the planet gear 8 or 9 are the same and the number of teeth of the inner toothed annular gear 10 or 11 is the same and three times that of the planet gear 8 or 9, respectively. Therefore, an orbital rotation angle of the planet gear 8 or 9 corresponds to one third rotation of the drive shaft 1 when the center gear 6 or 7 which rotates together with the drive shaft 1 rotates 4/3 rotations. Although, for a planet gear device using usual circular gears, a relation of a rotation amount of a center gear to an orbital rotation amount of the planet gear is always linear under a condition where an internal toothed gear is fixed, it is clear that the relation between the rotation amount and the orbital rotation amount.. changes periodically in correlation to the configurations of the non-circular gears in the planet gear device 4 or 5 constituted with non-circular gears. However, since practical planet gear device constituted with non-circular gears is rare, an explanation of the periodical change with respect to the drawings will be helpful to understand the invention. It is assumed that a relative position of the constituent components shown in FIG. 5*a* is a reference. A reference line l connecting a center O of the drive shaft 1 and a dot P marked at a constant position of the outer toothed annular gear 10 or 11 is set. A center position of the planet shaft 20 or 21 is shown by Q or R. Further, a dot S is marked as a certain position on the center gear 6 or 7. In FIG. 5*a*, all of the points P, Q, S, O and R are on the reference line l and this is referred to as a reference condition. FIGS. 5*b* to 5*e* are the same as FIG. 5*a* with the center gear 6 or 7 being rotated by one third rotation from the reference condition sequentially in clockwise direction. In FIG. 5*b*, the points Q, O and R are not on the reference line l and a distance between the point R and the reference line l is larger than that between the point Q and the reference line l. This means that, with one third revolution of the drive shaft 1 from the reference condition, an orbital rotation amount of the planet shaft 21 is large compared with the planet shaft 20. In FIG. 5*c*, the points Q, O and R are on a straight line. However, since the point S is intermediate between the points 0 and R, the condition is not considered as being returned to the reference condition shown in FIG. 5*a*. After a condition shown in FIG. 5*d*, the points Q, S, O and R are on a straight line and it can be said that the condition is returned to the reference condition in FIG. 5*a* except a positional relation to the point P. In the condition shown in FIG. 5*e*, the drive shaft 1 is rotated from the reference condition by an amount corresponding to 4/3 revolutions, which corresponds to a one third revolution of the planet shaft 20 or 21 around the point O. A period of movement of the device with a periodic variation of the planet shaft 20 or 21 is defined from the reference condition to the latter condition. A major period within which the positional relation of all of the constitutional components is returned to the reference condition is 3 times the period mentioned above which corresponds to 4 revolutions of the drive shaft 1. FIG. 6 is a graph showing the movement of the planet gear device 4 or 5 shown in FIGS. 5*a* to 5*e* quantitatively. In the graph, the periodical revolutions of the planet shafts 20 and 21 during 4 revolutions of the drive shaft 1 to complete the major period are shown by a solid line and a dotted line, respectively, with abscissa and ordinate being the angle <POS and angles <POQ and <POR-180° in FIGS. 5*a* to 5*e*, respectively.

FIGS. 7*a* to 7*c* show the rotary piston 18 or 19. The rotary piston 18 is identical to the piston 19 in configuration. In these figures, 31 is a recess sector and three recess sectors are arranged equiangularly. 32 is a protrusion sector and three protrusion sectors are arranged equiangularly. 33 or 36 and 34 or 35 are suction port and discharge port, respectively. The rotary pistons 18 and 19 are arranged axially oppositely and disposed such that the protrusion sectors 32 of one of them are put in the recess sectors 31 of the other, as shown in FIG. 4.

Figure 8A:
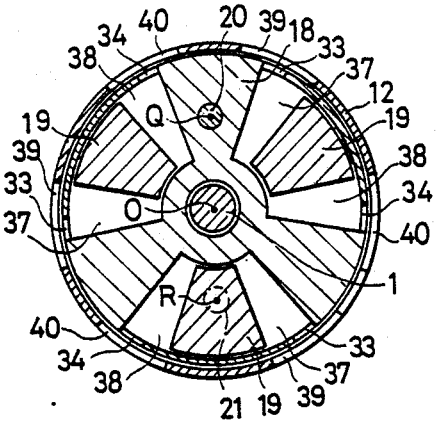
Figure 8B:
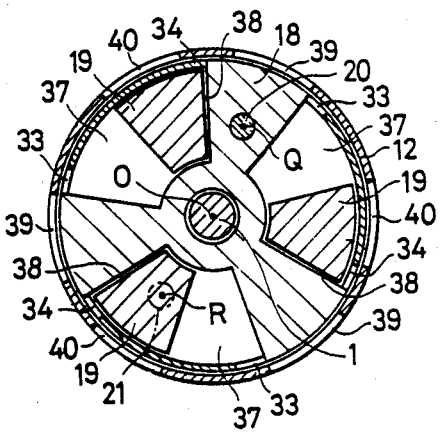
Figure 8C:
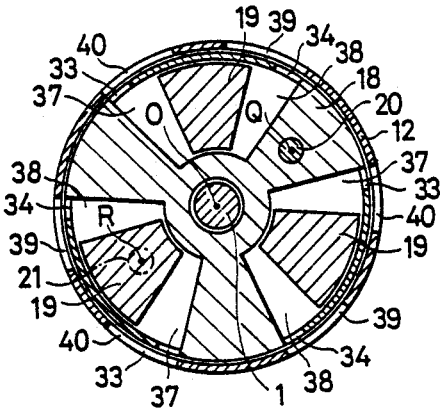
Figure 8D:
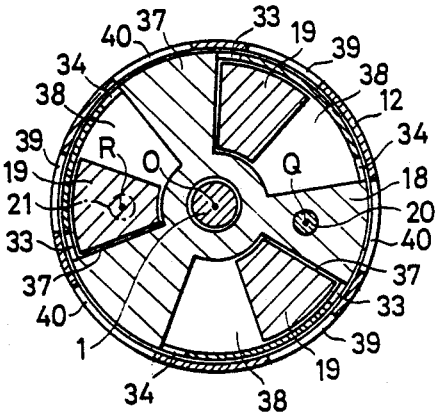
Figure 8E:
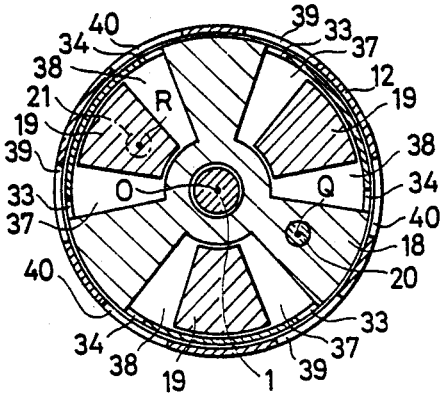

FIGS. 8*a* to 8*e* show cross sections of the portion of the annular cylinder 17 of the device shown in FIG. 4 in a plane vertical to the drive shaft 1, respectively. Points O, Q and R in these figures depict center positions of the drive shaft 1, the planet shaft 20 and the planet shaft 21, respectively, as in FIGS. 5*a* to 5*e*. When the planet shafts 20 and 21 rotate relatively periodically at variable speeds as shown in FIG. 6, the protrusion sectors 32 swing relatively in the recess sectors 31. In FIGS. 8*a* to 8*e*, periodic variations of volumes of spaces in the recess sector 31 defined by the protrusion sector 32 disposed therein, that is, the first space 37 and the second space 38 shown in FIG. 8*a* are shown. The positional relation of the components in FIGS. 8*a* to 8*e* is shown with the same rotation amounts of the drive shaft 1 from the reference condition as those in FIGS. 5*a* to 5*e*, respectively. Therefore, a period from the condition shown in FIG. 8*a* to the condition shown in FIG. 8*e* corresponds to the period in which the movements of the rotary pistons 18 and 19 change periodically. The major period is 3 times this period, during which the rotary pistons 18 and 19 perform one complete revolution together around the drive shaft 1 and all of the components return to the reference condition. FIG. 9 is a graph showing variations of volumes of the first space 37 and the second space 38 quantitatively during the drive shaft 1 performs 4 complete revolutions corresponding to the major period, in which a solid line and a dotted line show those of the first space 37 and the second space 38, respectively. Volume Vmin in ordinate is a volume of the second space 38 in FIG. 8*b* which is also the volume of the first space 37 in FIG. 8*d*. Volume Vmax is the volume of the first space 37 in FIG. 8*b* which is also the second space 38 in FIG. 8*d*. The characteristics curves in FIG. 9 show the most important one of functions to be achieved by the rotary pump device according to the present invention. That is, the basic function required by the rotary pump device, i.e., to change periodically volumes of the first space 37 and the second space 38 defined by the rotary pistons 18 and 19 at each of three locations in the annular cylinder 17, respectively, is achieved.

A suction and discharge valve function of the device according to the present invention will be described. Heretofore, the first and second spaces 37 and 38 rotate together in the same direction as that of the drive shaft 1 and the period of volume change thereof are 120° relative to the cylinder base 12, respectively. Since the recess sectors 31 and the protrusion sectors 32 of the rotary pistons 18 and 19 are formed at three locations separated by 120°, respectively, in coincidence to the aforesaid period, a total volume of the first spaces 37 and a total volume of the second spaces 38 take the same value every 120° relative position to the cylinder base 12, respectively. By utilizing this characteristics of movement, it is possible to provide a suction port and a discharge port in the cylinder base 12 which make the suction/discharge ports 33 and 34, 35 and 36 provided in the rotary pistons 18 and 19 in communication with or separated from each other according to demand by taking the period of positional change of the ports 33 to 36, the period of volume change of the first and second spaces 37 and 38 and the phase thereof into consideration and to cause them to operate as a rotary valve mechanism.

Figure 10A:
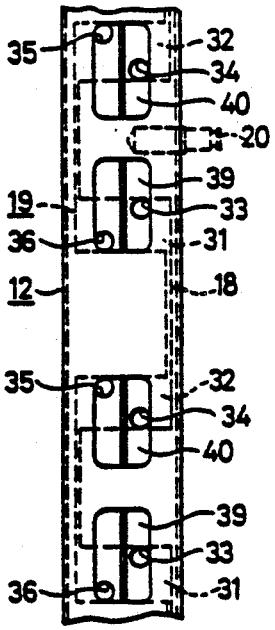
Figure 10B:
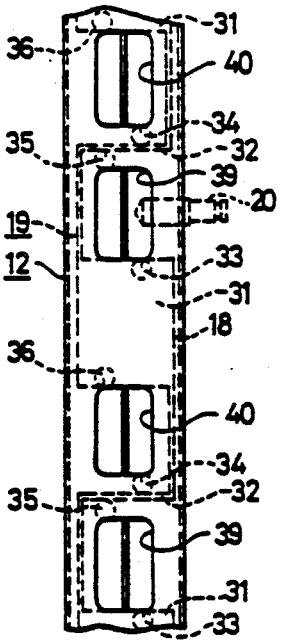
Figure 10C:
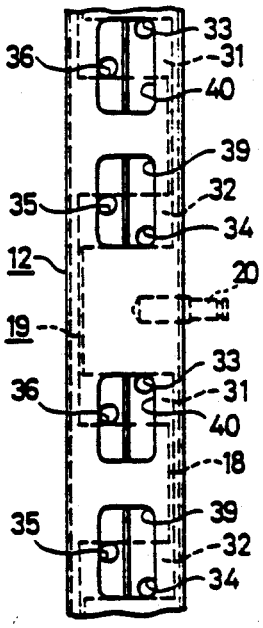
Figure 10D:
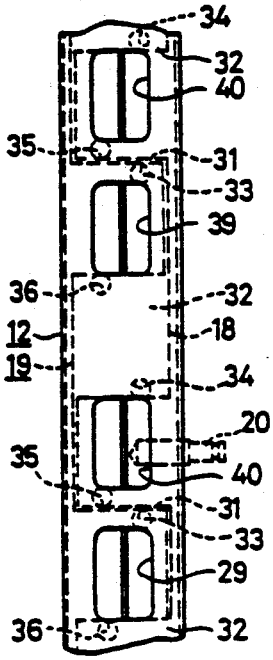
Figure 10E:
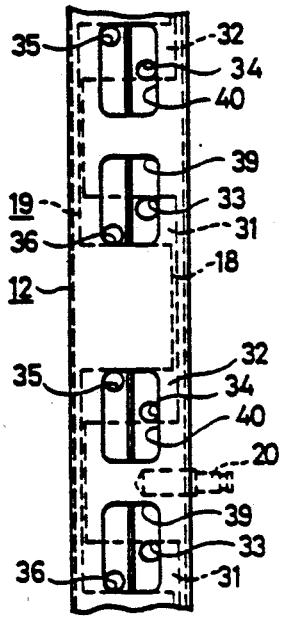
Figure 11:
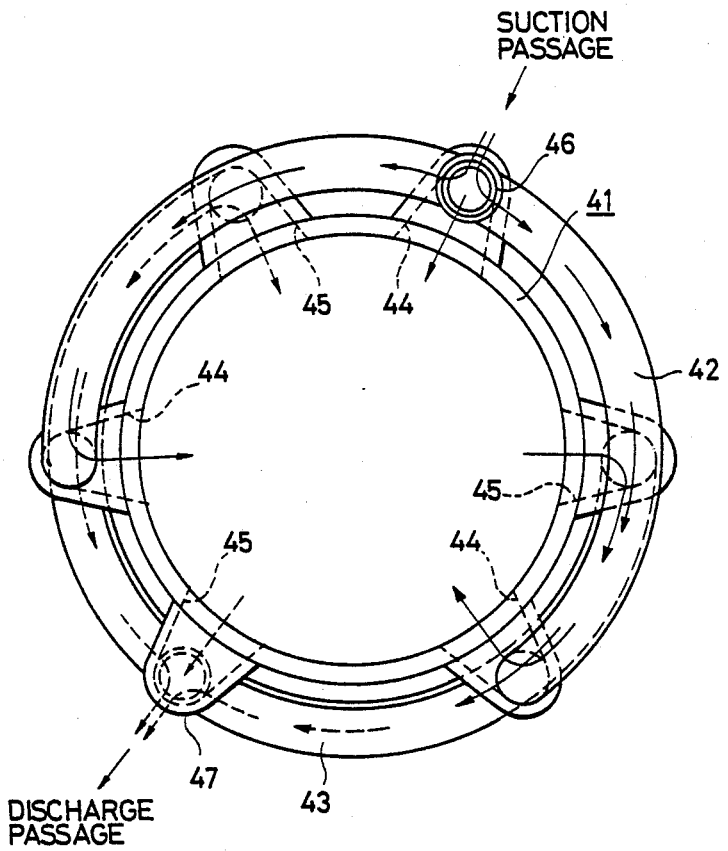

FIGS. 10*a* to 10*e* are for explanatory purpose of a construction and operation of the rotary valve mechanism. In these figures, the outer cylindrical surface of the cylinder base 12 in FIG. 4 is extended to illustrate a relation of the cylinder base 12 to an interior of the annular cylinder 17 therein. 39 and 40 are an intake port and a discharge port provided in the cylinder base 12, respectively. FIG. 10*a* corresponds to the reference condition shown in FIG. 8*a*, in which the volume of the first spaces 37 is increasing and the suction/discharge port 33 of the rotary piston 18 and the suction/discharge port 36 of the rotary piston 19 are communicated with the suction port 39 and acting as a suction inlet together therewith. The volume of the second spaces 38 is decreasing and the suction/discharge port 34 of the rotary piston 18 and the suction/discharge port 35 of the rotary piston 19 are communicated with the discharge port 40 and acting as a discharge port together therewith. FIGS. 10*b* to 10*e* correspond to the conditions shown in FIGS. 8*b* to 8*e*, respectively. In FIG. 10*b*, the first spaces 37 have the maximum volume Vmax and the communication of the suction/discharge port 33 of the rotary piston 18 with the suction port 39 is just cut off. The volume of the first spaces 37 starts to decrease immediately after this condition. In synchronism with this, the suction/discharge port 36 of the rotary cylinder 19 is going to communicate with the discharge port 40. The second spaces 38 have the minimum volume Vmin and the communication of the suction/discharge port 34 of the rotary cylinder 18 with the discharge port 40 is just cut off. The volume of the second spaces 38 starts to increase immediately after this condition and, in synchronism therewith, the suction/discharge port 35 of the rotary cylinder 19 communicates with the suction port 39. Similarly, in FIGS. 10*c* to 10*e*, a suitable synchronization is established between the variations of volumes of the first and second spaces 37 and 38 to form the rotary suction and discharge valve mechanism for controlling communication between the suction/discharge ports 33 to 36, the suction port 39 and the discharge port 40.

FIG. 11 shows an embodiment of communication means for connecting the suction ports 39 and discharge ports 40 opened outwardly of the cylinder base 12 to a suction and a discharge conduits provided outside of the device. In FIG. 11, 41 is an annular manifold composed of a suction manifold 42 and a discharge manifold 43, an inner portion of the annular manifold 41 being fitted on an outer portion of the cylinder base 12 such that suction openings 44 are communicated with the suction port 39 of the cylinder base 12 and discharge openings 45 are communicated with the discharge port 40. 46 is a suction nipple and 47 is a discharge nipple.

It should be noted that the basic configuration of each of the non-circular gears constituting the planet gear devices 4 and 5 in the embodiment shown in FIGS. 4 to 11 is an ellipsoidal gear. However, the configuration of the non-circular gear does not relate directly to the features of the rotary pump device according to the present invention. Although the gears should be non-circular and the planet gear mechanism should be constituted therewith, other matters are not limited to those mentioned.

As mentioned hereinbefore, according to the present invention, a planet gear device composed of a center gear, planet gears and an inner toothed annular gear all of which are noncircular gears and a mechanism for rotating a plurality of rotary pistons in an annular cylinder at periodically variable speeds in synchronism with non-constant orbital movements given by the planet gear device to a plurality of planet shafts are provided. Therefore, it is possible to exclude any eccentricity and/or abnormality of configuration as to the cylinder and the pistons and to machine the portions which are essential for leakage sealing coaxial circular shapes, so that the machining precision is maintained with a reduced number of steps. Further, since the planet gear device including non-circular gears is used as means for driving the rotary pistons at periodically variable speeds, driving machine loss is small and an inertia loss due to the swinging rotation of the rotary pistons is restricted, resulting in a rotary pump device which is superior than the conventional device.

POSSIBILITY OF INDUSTRIAL UTILIZATION

The rotary pump device according to the present invention is applicable to suction/discharge of gas, and also applicable to a compressor for compressing gas and discharging it according to demand, or to a reducing machine such as a certain vacuum pump which expands suction gas and discharge it, a fluid motor acting in reverse manner to a pump to perform a rotary works by energy of pressurized fluid or an rotary piston type internal and external combustion engine with a suitable timing of suction and discharge.

I claim:

1. A rotary pump apparatus, comprising:

(a) means (12-16) defining a cylindrical chamber (17), (b) suction port means and discharge port means individually defined by the chamber, (c) a pair of generally cylindrical rotary pistons (18, 19) disposed within the chamber, each piston defining a plurality of sector shaped, axially directed projections (32) individually separated by an equal plurality of sector shaped recesses (31) spanning greater arcs than the projections, said pistons being disposed facing each other such that the projections of each are accommodated within the recesses of the other, (d) a drive shaft (1) extending centrally and axially through the chamber and pistons, (e) bearing means rotatably supporting the pistons on said drive shaft, (f) a pair of sun and planet gear systems (4, 5) disposed axially flanking the chamber and pistons and individually associated with said pistons, each system comprising:

(1) a non-circular sun gear (6, 7) eccentrically mounted to the shaft for rotation therewith, (2) a non-circular planet gear (8, 9) eccentrically mounted to an associated piston and disposed in engagement with an association sun gear, and (3) a stationary ring gear (10, 11) surrounding and engaging an associated planet gear, and having a non-circular inner configuration, (g) wherein the planet gears undergo orbital rotation which impart cyclical speed, continuous rotation to the respective pistons, which in turn continuously expands and contracts sector shaped spaces between adjacent projections of the pistons to implement pumping.

* * * * *